US006322062B1

(12) United States Patent
Conn et al.

(10) Patent No.: US 6,322,062 B1
(45) Date of Patent: Nov. 27, 2001

(54) CABINET INSTALLATION LIFTING SYSTEM

(76) Inventors: Edwin L. Conn, 408 Carol Benne Ct., O'Fallon, MO (US) 63366; Tommy M. McDowell, 50 Jamaica Dr., St. Peters, MO (US) 63376

( * ) Notice: Subject to any disclaimer, the term of this patent is extended or adjusted under 35 U.S.C. 154(b) by 0 days.

(21) Appl. No.: 09/427,993

(22) Filed: Oct. 27, 1999

(51) Int. Cl.[7] ..... E04G 21/14

(52) U.S. Cl. ..... 269/20; 269/37; 269/69; 269/289 R; 269/904; 254/93 H; 254/134

(58) Field of Search ..... 254/934, 134, 254/100, 133 A; 269/904, 37, 69, 289 R, 20

(56) References Cited

U.S. PATENT DOCUMENTS 3,567,183 * 3/1971 Voss ..... 254/93 H
3,727,884 * 4/1973 Custer ..... 254/100
4,123,038 * 10/1978 Meyers ..... 254/134
4,723,756 * 2/1988 Stumpf ..... 254/93 H
4,955,592 * 9/1990 Brennan ..... 269/904
5,139,233 * 8/1992 Goss ..... 254/134
5,372,353 * 12/1994 West ..... 254/134

* cited by examiner

*Primary Examiner*—Robert C. Watson
(74) *Attorney, Agent, or Firm*—Polster Lieder Woodruff & Lucchesi, L.C.

(57) ABSTRACT

A cabinet installation lifting system and its method of use are disclosed. The cabinet installation lifting system has a base section, a lifting mechanism attached to the base section, and at least one platform attached to the top part of the lifting mechanism. A second, upper platform section may be removably attached to the first platform section by means of at least one removable extension. When different sized cabinets are installed, different sized removable extensions are selected for the appropriate overall height of the cabinet installation lifting system. Installation of wall cabinets is performed by installing a base cabinet, placing the cabinet installation lifting system on the base cabinet, placing the wall cabinet to be installed on the cabinet installation lifting system, lifting the wall cabinet to the desired height, securing the wall cabinet, and removing the cabinet installation lifting system.

9 Claims, 4 Drawing Sheets

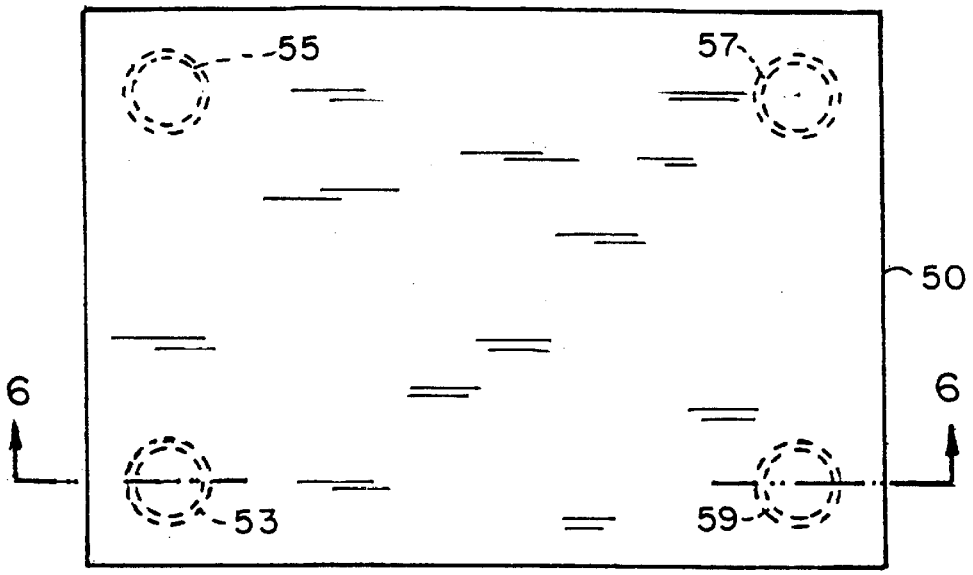
FIG.5
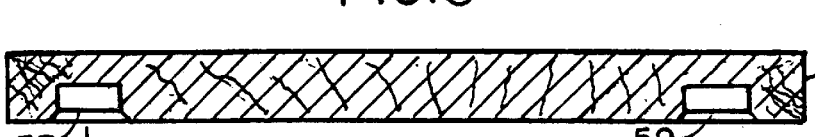
FIG.6
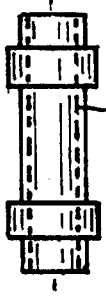
FIG.7
FIG.8
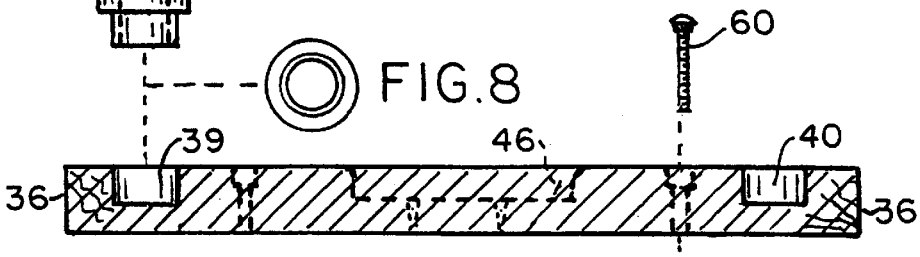
FIG.10
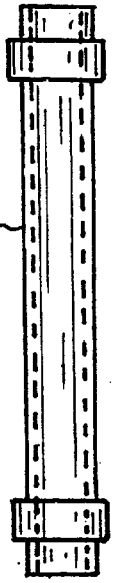
FIG.12
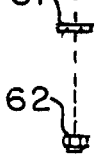

CABINET INSTALLATION LIFTING SYSTEM

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The installation of hanging cabinets on walls has been a traditionally cumbersome and potentially hazardous activity. In order to secure the cabinets, typically two workers are required to perform the installation. With this method, prior to the installation of ground-level cabinets, the wall cabinets are installed. One worker holds the cabinet in place against the wall, while the other worker secures the cabinet to the wall, usually with screws. This operation is relatively expensive, since two workers are required.

If only one worker is available to perform the installation of wall cabinets, the worker will typically prop the cabinet in place with a board or post holding the cabinet with one hand and securing the cabinet with a screwdriver with the other hand. This method presents a precarious and potentially injurious situation, as the board or post cannot hold the cabinet reliably. It is therefore desirable to provide an inexpensive but safe method of installing wall cabinets.

BRIEF SUMMARY OF THE INVENTION

The present invention relates to a cabinet lifting system for installation of wall type cabinets.

The cabinet lifting system of the present invention has three primary parts; a base section, a lifting mechanism resting upon the base section, and a platform section oriented above the lifting mechanism. The lifting mechanism is capable of raising the platform section and keeping the platform section in place for holding a wall cabinet, and lowering away from the wall cabinet after the wall cabinet is fixed to the wall. The cabinet lifting system of the present invention is portable. The platform section of the cabinet lifting system is preferably modular, with an upper and lower platform spaced apart by intermediate, removable extensions. Different sized cabinets may be accommodated by utilization of appropriately selected intermediate extensions.

Unlike typical installation procedures, the present invention is employed after the installation of the ground level cabinets. The cabinet lifting system is positioned on top of a ground level cabinet, and the wall cabinet to be installed is placed on the cabinet lifting system. The wall cabinet to be installed is then raised to the appropriate position on the wall, and held in place by the cabinet lifting system. After the wall cabinet is secured to the wall, the cabinet lifting system is removed by releasing the lifting mechanism, thereby lowering the upper platform of the cabinet lifting system away from the installed cabinet.

BRIEF DESCRIPTION OF THE SEVERAL VIEWS OF THE DRAWINGS

The objects of the invention are achieved as set forth in the illustrative embodiments shown in the drawings which form a part of the specification.

FIG. 5 is a bottom plan view of a top platform of a cabinet lifting system of the present invention;

FIG. 6 is a cross sectional view of a top platform of a cabinet lifting system of the present invention;

FIG. 7 is a side elevational view of a removable extension of a cabinet lifting system of the present invention;

FIG. 8 is a top plan view of a removable extension of a cabinet lifting system of the present invention;

FIG. 10 is a cross sectional view of a bottom platform of a cabinet lifting system of the present invention;

FIG. 12 is a side elevational view of an alternative removable extension of a cabinet lifting system of the present invention;

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 2:
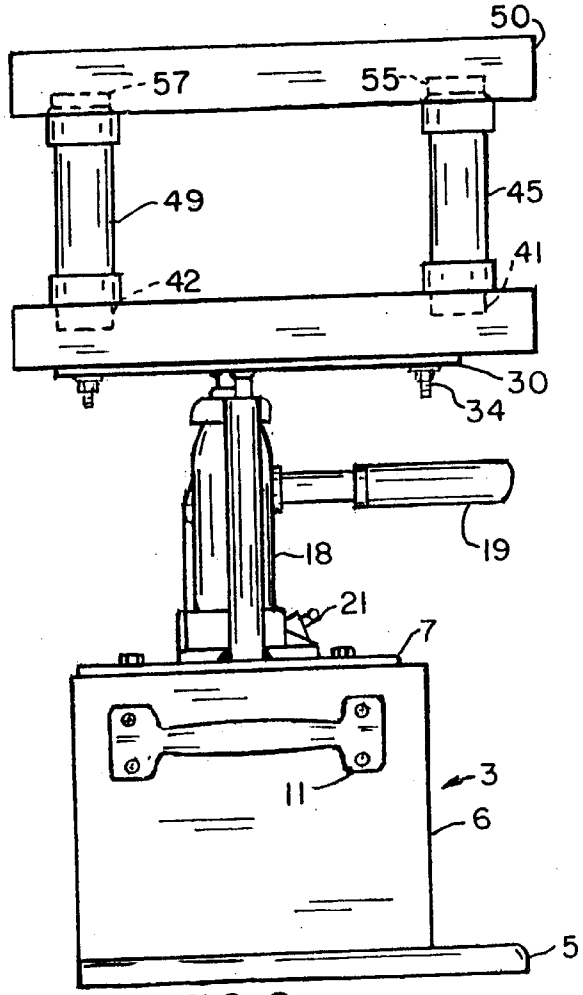
FIG. 2 is left side elevational view of a cabinet lifting system of the present invention.
Figure 1:
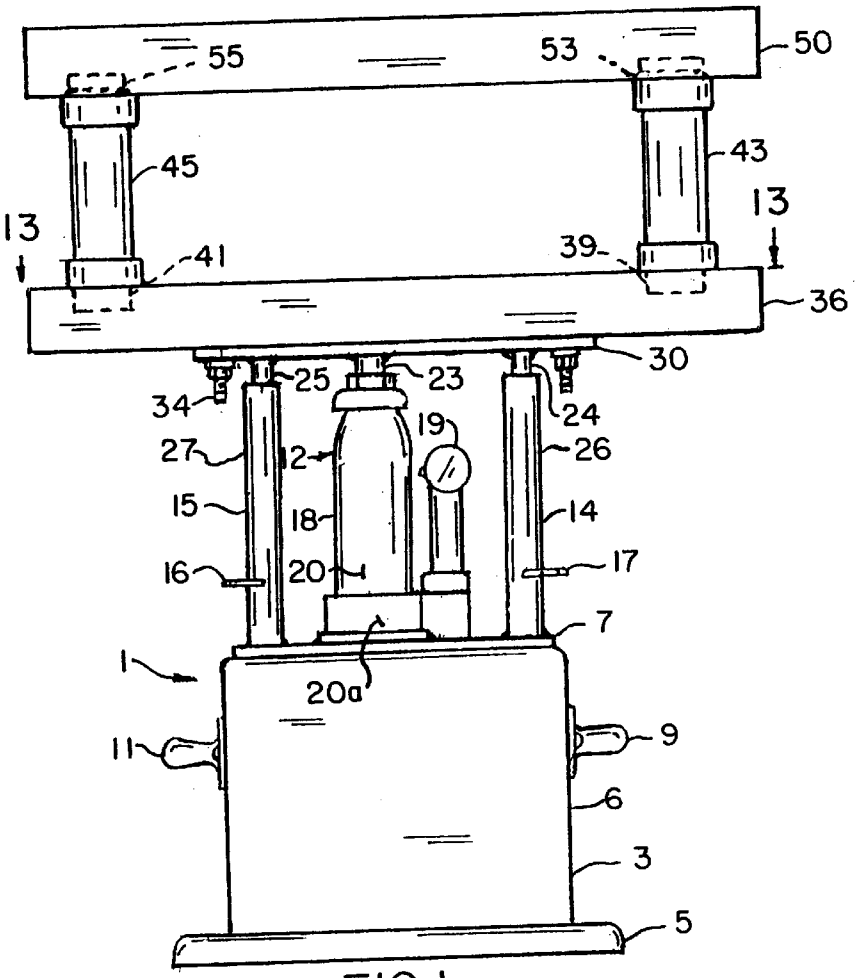
FIG. 1 is a view in front elevation of a cabinet lifting system of the present invention.
Figure 4:
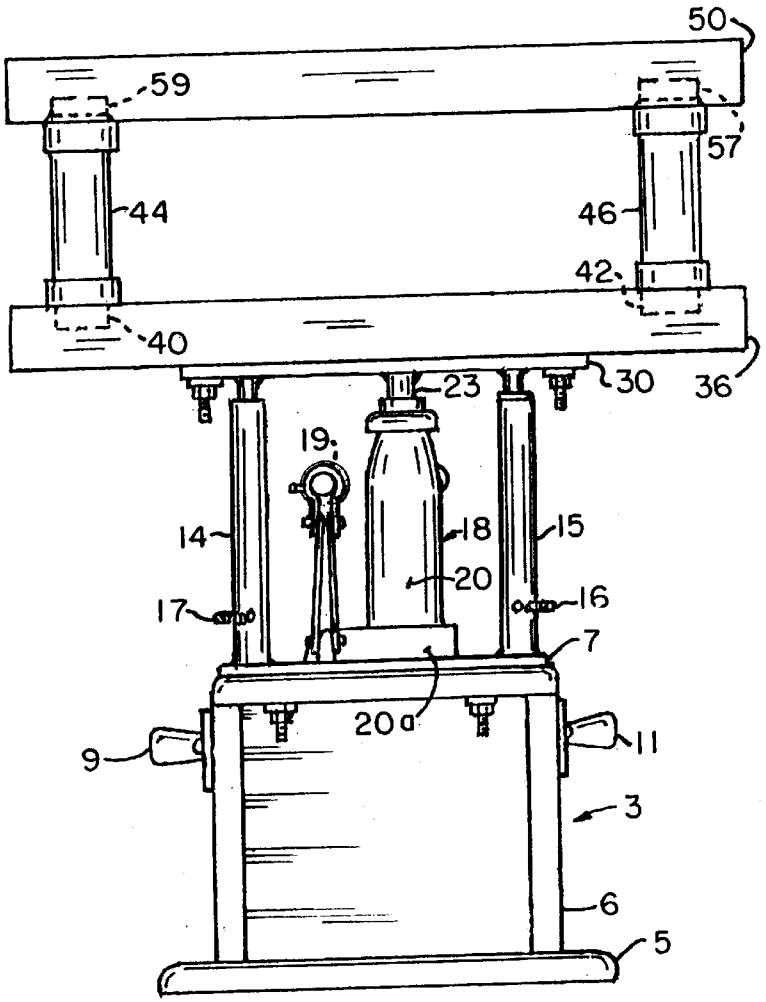
FIG. 4 is a rear elevational view of a cabinet lifting system of the present invention.
Figure 3:
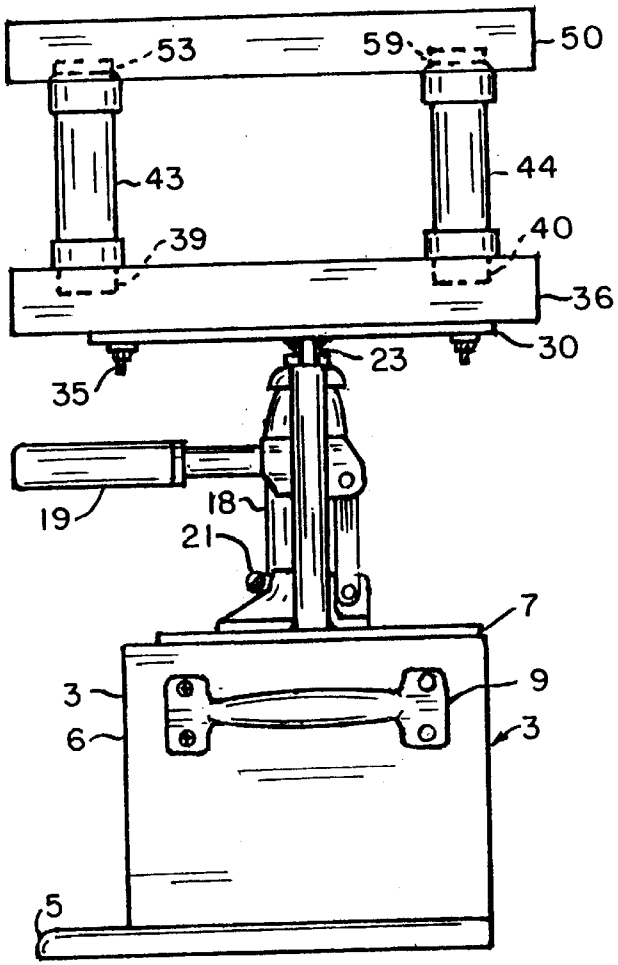
FIG. 3 is right side elevational view of a cabinet lifting system of the present invention.

First, from a general standpoint, and with particular reference to FIGS. 1 and 4, a cabinet lifting system 1 of the invention comprises a base section 3 with a lifting mechanism 12 mounted thereabove. Assembly 1 has a lower platform 36 mounted to lifting mechanism 12. Assembly 1 further has removable extensions 43, 44, 45 and 46 that engage lower platform 36 to support an upper platform 50.

Base 3 comprises a lower base section 5, a central base portion 6 and an upper base securement plate 7. In the preferred embodiment, base section 3 is fitted with side handles 9 and 11 secured as by screws, for ease of carrying and maneuvering the base section. Referring to FIGS. 1–4, it will be appreciated that lower base 5 preferably is wider than central base portion 6, for purposes of stability. For example, in the preferred embodiment, lower base section 5 is preferably from about 9" square to about 13" square, more preferably about 11" square, and from about ½" thick to about 2" thick, more preferably about 1" thick. Central base portion 6 is preferably from about 6" square to about 10" square, more preferably about 8½" square, and ranges from about 5" in height to about 8" in height, more preferably about 7" in height from the lower base section 5. The entire base section 3 is therefore about between 6½" to 12" in height, most preferably about eight (8) inches in height. In the preferred embodiment, the lower base section 5 projects in front of the central base portion 6, and the rear end of the central base portion 6 is approximately flush with the lower base section 5.

As can best be seen in FIGS. 2, 9, 9A, 9B, 11 and 16, base securement plate 7 is bolted to central portion 6 by nuts 33, spacers 34, and bolts 35 that pass through holes 8 in base section securement plate 7 and through holes 4 in central base portion 6. The lifting mechanism 12 is intermediate the base 3 and the lower platform 36, and provides the required raising action for the cabinets to be installed. The lifting mechanism 12 is securely attached to the base 3 through securement plate 7. The lifting mechanism 12 is likewise firmly secured to the lower platform 36 through bottom platform securement plate 30. In the preferred embodiment, the lifting mechanism 12 comprises a standard hydraulic jack 18. Jack 18 comprises a handle 19 mounted to a housing 20 which has a base 20*a*. Jack 18 also comprises a release lever 21 mounted to the jack base 20*a*, and a neck portion 23 that extends through an opening at the upper end of the housing 20. Housing 20 contains the hydraulic structure known in the art for operating the handle 19 to raise and lower neck 23. Jack 18 can be one such as the Model B-002NC 2-ton hydraulic bottle jack available from MVP America of Kansas City, Mo. Raising of the lower platform 36 is accomplished by positioning the release lever 21 in the locked position, and pumping the handle 19 to raise the neck 23. Lowering the lower platform 36 is accomplished by positioning the release lever 21 in the unlocked position. The travel distance, or distance that the jack neck 23 moves from its lowermost position to its uppermost position is preferably about 3" to about 6", and most preferably about 4½". In its lowered state, the height of the lifting mechanism 12, relative to securement plate 7, is between 5" and 8", most preferably about 7".

Two guide and stabilizer arms, 14 and 15, are permanently attached to the base plate 7 at their lower ends, and to the bottom platform plate 30 at their upper ends. Stabilizer arms 14 and 15 have an upper member 24 and a lower member 26, and in the preferred embodiment the upper member 24 and lower member 26 are formed as telescopic concentric cylinders, comprising inner cylinders 24 and 25, respectively, slidably telescopically snugly received within outer cylinders 26 and 27, respectively. The lower ends of outer cylinders 26 and 27 are firmly secured to base plate 7, as by welding. The upper ends of inner cylinders 24 and 25 are likewise firmly secured to the underside of platform plate 30, as by welding. The upper end of jack neck 23 is secured to plate 30 as by welding. The arms 14 and 15 guide the vertical movement of platform 36 relative to base 3 to prevent wobbling and to provide stability. The arms 14 and 15 also stabilize the platform 36 relative to base 3 when the platform 36 is in fixed position, to resist tilting and twisting forces against platform 36. Inner cylinders 24 and 25, and outer cylinders 26 and 27, each have diametrically aligned bores extending therethrough and sized to receive the straight sections of retaining pins 16 and 17. When pins 16 and 17 are installed, the cylinders 24 and 25 are locked with cylinders 26 and 27, to secure said cylinders against movement for transporting or storage. The pins 16 and 17 can be gripped by the hand and pulled from cylinders 24–27, so that cylinders 24 and 25 can slide relative to cylinders 26 and 27, respectively.

Referring now to FIGS. 1–4 and FIG. 13, lower platform 36 is securely connected to the plate 30. In the preferred embodiment, lower platform 36 is generally rectangular, with a length of about 18", a width of about 13" and a height of about between 1" and 2", most preferably about 1½". The width of the lower platform 36 allows the platform 36 to fit inside the sides of a standard wall cabinet, and abut the floor or lower surface of the standard wall cabinet. Lower platform 36 has recessed holes 39, 40, 41 and 42 formed in the upper surface. In the preferred embodiment, recessed holes 39, 40, 41 and 42 are generally cylindrical, with a diameter of about between 1" and 3", most preferably about 1¾" and extending to a depth of about ¾" into lower platform 36. Preferably, recessed holes 39, 40, 41 and 42 open into the top surface of lower platform 36 without a chamfered edge. It may be desirable to fit the recessed holes 39–42 with sleeves (not shown) adapted to mate with the extensions. The sleeves may be removable, or more preferably secured in the recessed holes 39–42. The sleeves may be made of polyvinyl chloride (PVC) for example.

Figure 13:
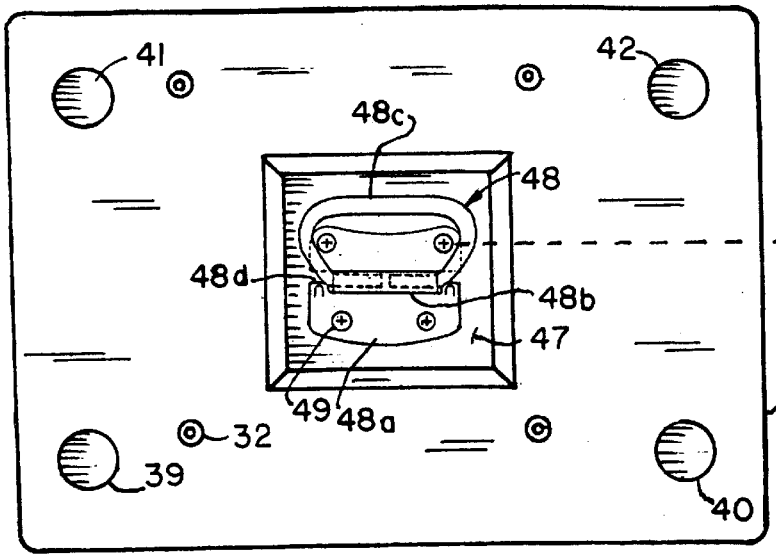
FIG. 13 is a top plan view of a bottom platform of a cabinet lifting system of the present invention.
Figure 14:
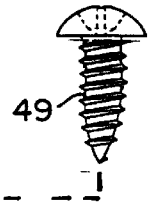
FIG. 14 is a screw for attachment of a handle of the bottom platform of FIG. 13.
Figure 15:
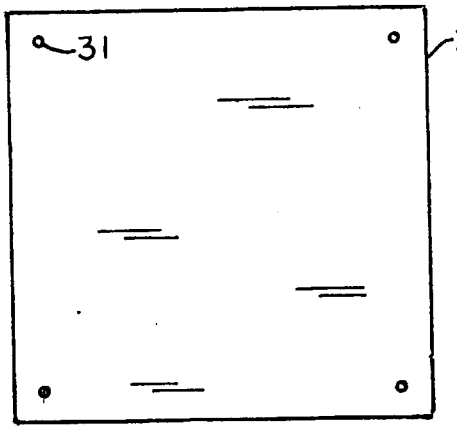
FIG. 15 is a bottom platform securement plate of a cabinet lifting system of the present invention.
Figure 9:
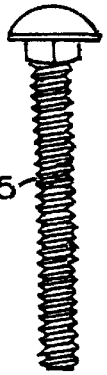
FIG. 9 is an exploded view of a securement means for a bottom platform of a cabinet lifting system of the present invention.
Figure 16:
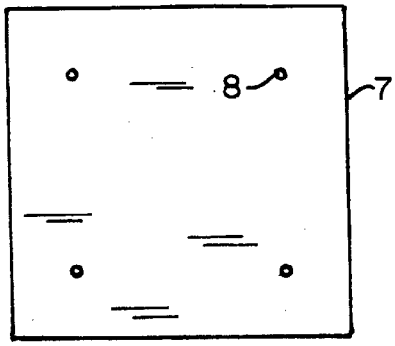
FIG. 16 is a base securement plate of a cabinet lifting system of the present invention.
Figure 11:
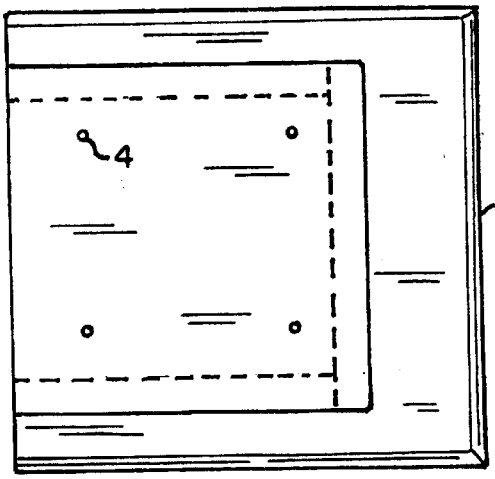
FIG. 11 is a top plan view of a base section of a cabinet lifting system of the present invention, not showing the lifting mechanism.
Figure 9A:
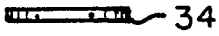
FIG. 9A is a spacer for a securement means for a bottom platform of a cabinet lifting system of the present invention.
Figure 9B:
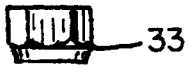
FIG. 9B is a nut for a securement means for a bottom platform of a cabinet lifting system of the present invention.
Figure 17:
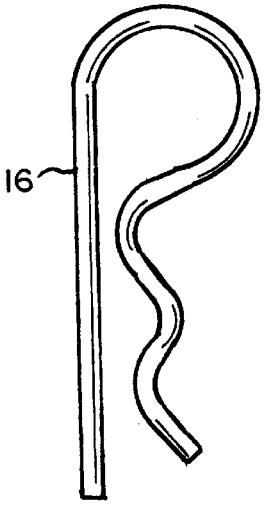
FIG. 17 is a retaining pin of a cabinet lifting system of the present invention.

Lower platform 36 preferably has at its upper surface a handle. Referring to FIG. 13, the top surface of lower platform 36 has a recess 47 in which a handle 48 resides. The handle 48 comprises a bracket 48*a* that is preferably secured to lower platform 36 as by self tapping screws 49. Bracket 48*a* has a raised inverted U-shaped wall 48*b* that receives the ends of a curved grip rod 48*c*, so that grip rod 48*c* can pivot relative thereto. Grip rod 48*c* can be pivoted to a horizontal position to be wholly within recess 47. Grip rod 48*b* can also be pivoted to an upright position so that the operator can grasp it to transport the cabinet installation lifting system 1 when it is in a lowered and locked state. Bracket 48*a* has a pair of stop plates 48*d* to one side of grip rod 48*b* to resist pivoting of the grip more than about 90°, to resist wobbling while carrying. Recess 47 allows for a wall cabinet to rest flush against the top surface of lower platform 36, without interference from handle 48 when the handle is pivoted to be within recess 47.

Lower platform 36 is attached to bottom platform securement plate 30 by bolts 60, spacers 61 and nuts 62. Bores 32 are formed in through lower platform 36 through which bolts 60 pass. The upper end of bore 32 is preferably enlarged and recessed, so that head of the bolts can fit therein to allow the top surface of lower platform 36 to be flat.

Upper platform 50 is preferably approximately the same shape as lower platform 36, that is, generally rectangular with dimensions of about 18" long by about 13" wide and about between 1" and 3" in height, most preferably about 1½" in height. Referring to FIG. 5, it can be seen that there are recessed holes 53, 55, 57 and 59 in the bottom surface of upper platform 50. The recessed holes 53, 55, 57 and 59 of upper platform 50 are positioned so that they can be aligned with recessed holes 39, 40, 41 and 42 of lower platform 36. Like the corresponding recessed holes 39–42 of lower platform 36, these recessed holes 53, 55, 57 and 59 may be fitted with sleeves (not shown) made from, for example, PVC. However, unlike the corresponding recessed holes in the lower platform 36, the recessed holes 53, 55, 57 and 59 are slightly rounded or chamfered at the bottom surface of upper platform 50. This chamfering promotes ease in guiding the ends of extensions 43, 44, 45 and 46 into holes 53, 55, 57 and 59. As can be seen in FIG. 6, the top surface of upper platform 50 is generally planar. This allows a wall cabinet to rest in a stable fashion on top of upper platform 50.

Removable extensions 43, 44, 45 and 46 are preferably cylindrical. The extensions 43, 44, 45 and 46 are installed in recessed holes 39, 40, 41 and 42 in the lower platform 36, and in the recessed holes 53, 55, 57 and 59 in the upper platform 5O. In the preferred embodiment, extensions 43, 44, 45 and 46 are about between 2" and 6" in height, most preferably about 4" in height, and about between 1" and 2", most preferably about 1¾" in outer diameter. Alternatively, as illustrated in FIG. 12, four extensions 70 can be used in place of extensions 43–46. Each extension 70 is preferably about between 10" and 14" in height, most preferably about 13" in height, and about between 1" and 2", most preferably about 1¾" in outer diameter. It is to be understood that an even longer extension could be used to compensate for higher ceilings or smaller cabinets. Such an extension could be about 18" in height. These heights correspond to the installation of a wall cabinet that between 12" and 42" in height, as will be described.

The overall height of the cabinet installation lifting system 1 in its lowered state varies with the height of the wall cabinet to be installed, and the height from the floor that the cabinet is to be secured. For a wall cabinet that is 12" high, the overall height for the entire system 1 is preferably about between 33" to 38" high, most preferably about 34". For a cabinet that is between 15" and 18" high, an overall height for the entire system 1 is preferably about between 26" and 31", most preferably about 29". For a cabinet that is 24" high, an overall height of system 1 of about between 20" and 25", most preferably 22" is contemplated. For a cabinet that is between 30" and 42" high, an overall height of system 1 of about between 14" and 19", most preferably about 16" is contemplated.

The overall height of the cabinet installation lifting system 1 in its raised state varies similarly. For example, for a cabinet that is between 15" and 24" high, an overall height of the system 1 is preferably about between 32" and 36", most preferably about 33 ". For a cabinet that is between 24" and 30" high, an overall height for system 1 of about 25" to 29", most preferably about 26½", is contemplated. For a cabinet that is between 30" and 42" high, an overall height of about 19" to 24", most preferably about 20", is contemplated. These distances correspond to the preferred travel distance of the jack neck 23, which is about 4½", and the height of the base cabinet upon which the cabinet installation lifting system rests. In the preferred embodiment of the present invention, these various heights are accommodated by the removable extensions 43–46, ad 70. The materials are preferably a moldable plastic material, such as Polyethylene or PVC for the base section 5, base central portion 6, platforms 36 and 50 and extensions 43–46 and 70. A metal material, such as stainless steel or aluminum can be used for the base plate 7, the lower platform plate 30, the lifting mechanism 12 and the stabilizer arms 14 and 15. Although these materials are preferred, other materials such as wood or fiberglass, for example, could easily be substituted within the intended scope of the present invention.

The method of installing wall cabinets using the cabinet installation lifting system of the present invention is accomplished as follows:

First, the lower or base cabinet is installed using the normal method of installation. It is to be noted that a standard size of base cabinet for residential use is 36" overall. The base cabinet typically is 34½" tall, and the top portion is about 1½" tall, for an overall height of 36" for the base cabinet. It is to be understood that the top does not necessarily need to be installed prior to use of the cabinet installation lifting system 1, but only the lower base cabinet need be installed. The top of this portion of the base cabinet may be covered by 2×2 or 2×4 boards used as spacers, which are typically about 1½" thick, to give an appropriate height of 36" overall to the base cabinet. Next, the appropriate height of the cabinet installation lifting system 1 is determined by measuring the height of the wall cabinet to be installed, and the distance from the ceiling that the wall cabinet is to be secured. For purposes of illustration only, a common ceiling height of 8' is taken for the following description, with the wall cabinet being essentially flush with the ceiling at its upper end. If the wall cabinet is to be less than 30" tall, then the upper platform 50 is used. Either extensions 43–46 or extension 70 are used with platform 50, depending on the height of the lower wall cabinet. It is to be understood that if the wall cabinet to be installed is 30" or taller, no extensions are needed. The cabinet installation lifting system 1 is then placed on the base cabinet, with any additional spacers in place, at the appropriate location, that is, the location under which the wall cabinet is to be installed. The wall cabinet is then placed on top of the cabinet installation lifting system 1. Finally, the lifting mechanism 12 of the cabinet installation lifting system 1 is engaged, lifting the wall cabinet to the appropriate height for installation. It is to be understood that in the preferred embodiment, the handle 19 of jack 18 is pumped to lift the lower platform 36. While the installer is securing the wall cabinet to the wall, the cabinet installation lifting system 1 maintains the wall cabinet at the correct height, and also maintains the wall cabinet upright, or vertically oriented. After the wall cabinet is secured, the upper portion of the cabinet installation lifting system 1 is then lowered by releasing the lifting mechanism 12, as by operation of release lever 21 in the preferred embodiment. Now the cabinet installation lifting system 1 is removed from the base cabinet, and the installation of the wall cabinet is complete.

Numerous variations will occur to those skilled in the art, without departing from the intended scope of the invention. For example, the extensions could be a rectangular solid or prism or other shape. There could be a single extensions or any number of extensions between the lower and upper platforms. The platforms could be a shape other than rectangular, such as circular or triangular. The lifting mechanism could be any appropriate jack or lifting device. The materials used could be varied extensively, so long as the materials selected are appropriate for the function they are to perform. These examples are merely illustrative.

In view of the above, it will be seen that the several objects and advantages of the present invention have been achieved and other advantageous results have been obtained.

Having thus described the invention, what is claimed and desired to be secured by Letters Patent is:

1. A cabinet installation lifting system comprising:

a base section for placement on a base cabinet;

a lifting mechanism positioned on said base section; and a platform section positioned over said base section and connected to said lifting mechanism, said platform being movable between at least a lower position and an upper position through operation of said lifting mechanism, and said platform sized to rest against the bottom of and support a wall cabinet, the platform having an upper surface with a recess formed in said upper surface of said platform, and a handle mounted to said platform within said recess; said handle being movable from a lowered position where the handle is wholly within the recess, to an upright position so that an operator's hand can grasp the handle and carry the system.

2. The cabinet installation system of claim 1 wherein said handle is attached to said platform by a bracket part, said handle having a grip rod attached to said bracket part, wherein said grip rod of said handle is pivotable from a position wholly within said recess in said platform to an upright position.

3. A cabinet installation lifting system comprising:

a base section for placement on a base cabinet;

a lifting mechanism positioned on said base section;

a first, lower platform section positioned over said base section and connected to said lifting mechanism, said first, lower platform being movable between at least a lower position and an upper position through operation of said lifting mechanism, said first, lower platform positioned over said lifting mechanism; a second, upper platform, said second, upper platform sized to rest against the bottom of and support a wall cabinet and said second, upper platform positioned over said first, lower platform section, said lower platform and said upper platform spaced apart by at least one intermediate, removable extension.

4. The cabinet installation lifting system of claim 3 wherein said extension is removable from said lower platform section.

5. The cabinet installation lifting system of claim 3 wherein said first_lower platform section is spaced from said second_upper platform section by a plurality of extensions.

6. The cabinet installation lifting system of claim 3 wherein said lower platform section is spaced from said upper platform section by four extensions.

7. The cabinet installation lifting system of claim 1 further comprising four extensions mountable to said lower platform and extending upwardly therefrom.

8. The cabinet installation lifting system of claim 3 wherein the lifting mechanism is a hydraulic jack.

9. The cabinet installation lifting system of claim 3 wherein said extension is removable from said upper platform section.

* * * * *